US006977719B2

(12) United States Patent
Terashima

(10) Patent No.: US 6,977,719 B2
(45) Date of Patent: Dec. 20, 2005

(54) BILL VALIDATOR

(75) Inventor: Toshikatsu Terashima, Nagano (JP)

(73) Assignees: Wintec Co., Ltd., Nagano (JP); Mars Engineering Corporation, Tokyo (JP)

( * ) Notice: Subject to any disclaimer, the term of this patent is extended or adjusted under 35 U.S.C. 154(b) by 252 days.

(21) Appl. No.: 10/389,881

(22) Filed: Mar. 18, 2003

(65) Prior Publication Data

US 2004/0184026 A1 Sep. 23, 2004

(51) Int. Cl.[7] ..... G06K 9/74
(52) U.S. Cl. ..... 356/71; 250/556; 194/302
(58) Field of Search ..... 356/71; 194/202, 194/454, 207, 302, 344, 350; 235/379; 382/135; 250/556, 559.4

(56) References Cited

U.S. PATENT DOCUMENTS 4,884,671 A * 12/1989 Gardellini ..... 194/207
4,889,978 A * 12/1989 Koshida et al. ..... 235/379
5,758,759 A * 6/1998 Negishi ..... 194/207

FOREIGN PATENT DOCUMENTS

JP 8-221640 A 8/1996

* cited by examiner

*Primary Examiner*—Gregory J. Toatley, Jr.
*Assistant Examiner*—Roy M. Punnoose
(74) *Attorney, Agent, or Firm*—Birch, Stewart, Kolasch & Birch, LLP

(57) ABSTRACT

The compact bill validator including a bill accommodating section comprises: a bill sending mechanism sending the bill inward from an inlet via a sending path; a bill identification section being provided to a mid part of the sending path; a turning section turning a traveling direction of the bill; and a bill accommodating section being contiguous with the bill sending mechanism, the bill accommodating section accommodating the bill which has been turned by the turning section. The bill accommodating section has an extended space, which corresponds to an outer part of the turning section. A rear part of the bill accommodated in the bill accommodating section is curved in the extended space.

11 Claims, 4 Drawing Sheets

BILL VALIDATOR

BACKGROUND OF THE INVENTION

The present invention relates to a compact bill validator, which is assembled in a game machine, e.g., a slot machine, or an automatic vending machine so as to check money bills inserted.

A conventional bill validator, in which bills are turned and accommodated in a bill accommodating section, is shown in Japanese Patent Gazette No. 8-221640.

In the bill validator including a turning section for turning a traveling direction of a bill, a bill sending mechanism is located above the bill accommodating section. With this structure, total length of the bill validator including the bill accommodating section can be shorter.

However, the bills are stretched and accommodated in the bill accommodating section. Therefore, the total length of the bill validator must be equal to or longer than the length of the bill. Namely, miniaturizing the device is limited. Especially, in the device shown in the Japanese Patent Gazette No. 8-221640, the turning section of the bill sending mechanism is projected from the bill accommodating section, so that the total length of the device must be longer than the length of the bill.

For example, a bill validator, which is attached to a slot machine, has no bill accommodating section. Bills checked by the device are conveyed to a remote accommodating place by a conveyor unit, which is installed on the rear side of slot machines. In this case, cost of installing the conveyor unit must be high.

To reduce the cost for installing the conveyor unit, the bill validator including the bill accommodating section is attached to each slot machine. However, as described above, miniaturizing the device is limited, so if the slot machine has no space for attaching the bill validator, the device cannot be used. Namely, the small-sized bill validator including the bill accommodating section is required.

SUMMARY OF THE INVENTION

An object of the present invention is to provide a compact bill validator including a bill accommodating section.

To achieve the object, the present invention has following structures.

Namely, the bill validator of the present invention comprises:

a casing;

an inlet from which a bill is inserted;

a bill sending mechanism sending the bill inward from the inlet via a sending path;

a bill identification section being provided to a mid part of the sending path;

a turning section turning a traveling direction of the bill which is sent by the bill sending mechanism; and a bill accommodating section being contiguous with the bill sending mechanism, the bill accommodating section accommodating the bill which has been turned by the turning section, wherein the bill accommodating section has an extended space, which corresponds to an outer part of the turning section, and a rear part of the bill accommodated in the bill accommodating section is curved in the extended space.

In the bill validator of the present invention, the rear part of the bill accommodated in the bill accommodating section can be curved in the extended space, so that the length of the bill accommodating section can be shorter. Therefore, total length of the bill validator can be shorter.

In the bill validator, the turning section may include:

a half cylindrical-shaped guide member being capable of rotating about an axial line, the guide member having an outer face, which faces the extended space at an initial position, and an inner face, which guides the bill so as to turn the bill; and a rotating mechanism rotating the guide member until the outer face of the guide member reaches a position opposite to the initial position so as to make the bill enter the extended space when the rear part of the bill reaches the inner face of the guide member.

With this structure, the extended space on the outer side of the turning section can be used as the bill accommodating section, so that the total length of the device can be shortened.

In the bill validator, the bill sending mechanism may include a disk-shaped sending member, and the guide member may be provided coaxial with the sending member and capable of rotating about an axial line of the sending member.

With this structure, the bill can be stably turned between the sending member and the guide member.

In the bill validator, the sending member may include a plurality of elastic claws, which are provided in an outer circumferential face of the sending member and outwardly projected therefrom, and a groove, through which the claws pass, may be formed in the inner face of the guide member.

In the bill validator, the bill sending mechanism may includes: an outer pulley; an inner pulley; an endless belt being engaged between the pulleys; and a press roller pressing the bill onto the endless belt, and the guide member may be coaxial with the inner pulley and capable of rotating about an axial line of the inner pulley.

With this structure, the elastic claws are elastically deformed when they send the bill, so that the bell is securely pinched between the claws and the guide member. Therefore, the bill can be stably introduced into the device by enough frictional force. The claws which correspond to no bill enter and pass through the grooves, so no frictional force is generated between the claws and the guide member. Therefore, the claws can be smoothly driven by small driving force.

The bill validator may further comprise:

a couple of rails holding side edges of a front part of the bill, which has been turned by the turning section;

a press member pressing the front part of the bill, which has been held by the rails, so as to accommodate the bill into the bill accommodating section; and a driving section driving the press member.

With this structure, a jam occurred at a front end of the bill can be prevented.

In the bill validator, the rotating mechanism and the driving section may be synchronously driven.

With this structure, moving the bill into the extended space, which is caused by rotating the guide member, and pushing the bill into the bill accommodating section, which is caused by the press member, can be executed simultaneously, so that the front part and the rear part of the bill can be simultaneously moved toward the bill accommodating section. Therefore, the bill can be quickly and smoothly sent thereinto. Further, a part of the device including the rotating mechanism and the driving section can be small-sized.

The bill validator may further comprise a bill detecting section, which detects a bill in the bill accommodating section.

With this structure, the bill detecting section can check if the bill or bills exist in the bill accommodating section or not. So, miscollection of the bill can be prevented.

The bill validator may further comprise a flexible holding member being extended inward from an inner face of the casing, which faces the outer face of the guide member located at the initial position, the holding member elastically holding the bill with the outer face of the guide member.

With this structure, the bill is pressed toward the outer face of the guide member without slack. Therefore, in the case of accommodating a plurality of the bills, they can be held in the same postures in a curved part of the bill accommodating section.

In the bill validator, a surface of the holding member, which faces the guide member, may be a rough surface.

With this structure, frictional resistance between the bill and the holding member can be reduced, so that the bill can be smoothly introduced into the bill accommodating section.

The bill validator may further comprise a bill detecting section, which optically detects a bill on the holding member.

With this structure, the bill detecting section can check if the bill or bills exist in the bill accommodating section or not. If no bills exist, the detecting section optically detects the rough surface of the holding member, so that misdetection can be prevented.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
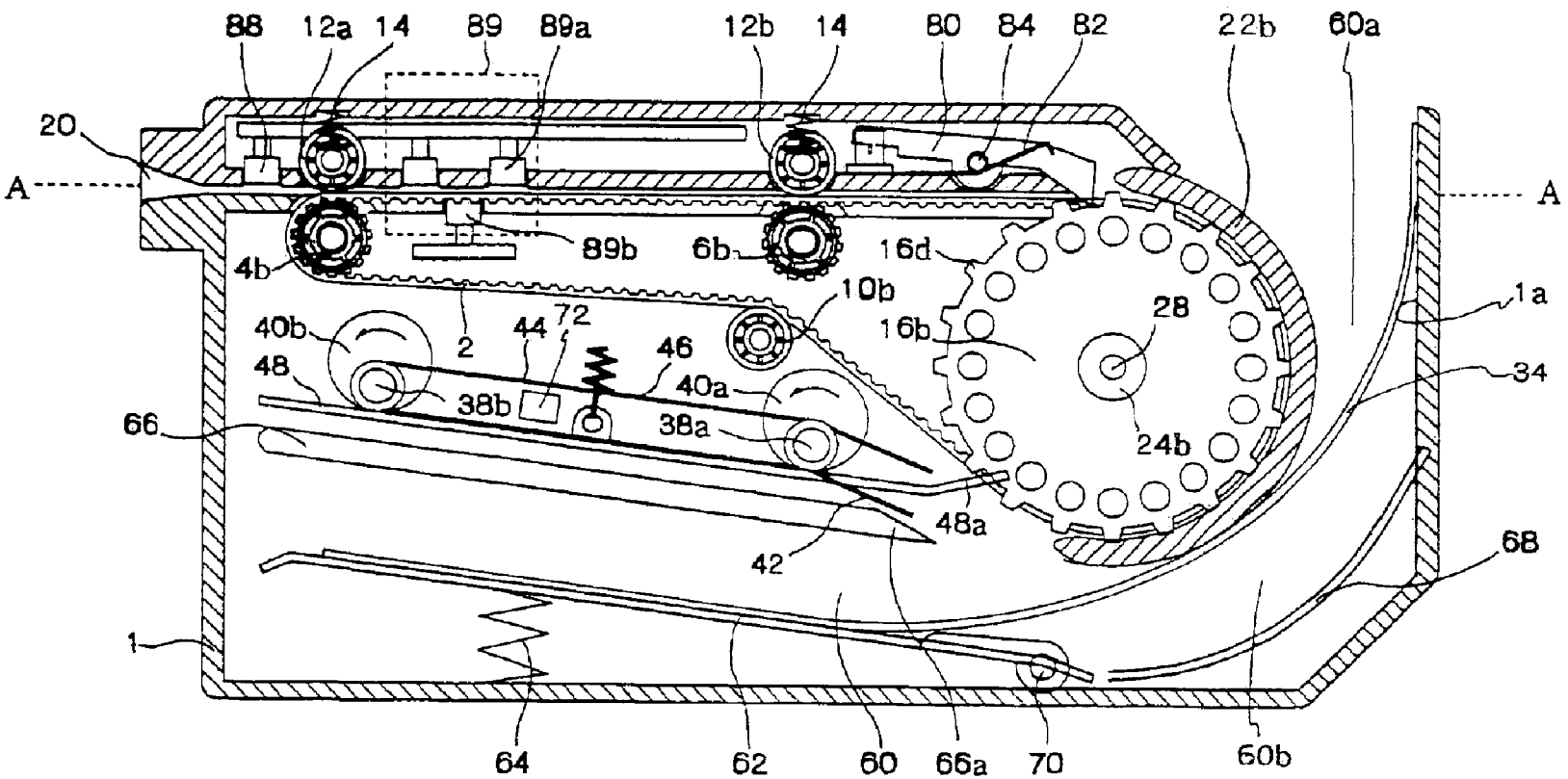
FIG. 1 is a side sectional view of a bill validator of an embodiment of the present invention, in which no bills are accommodated therein.
Figure 2:
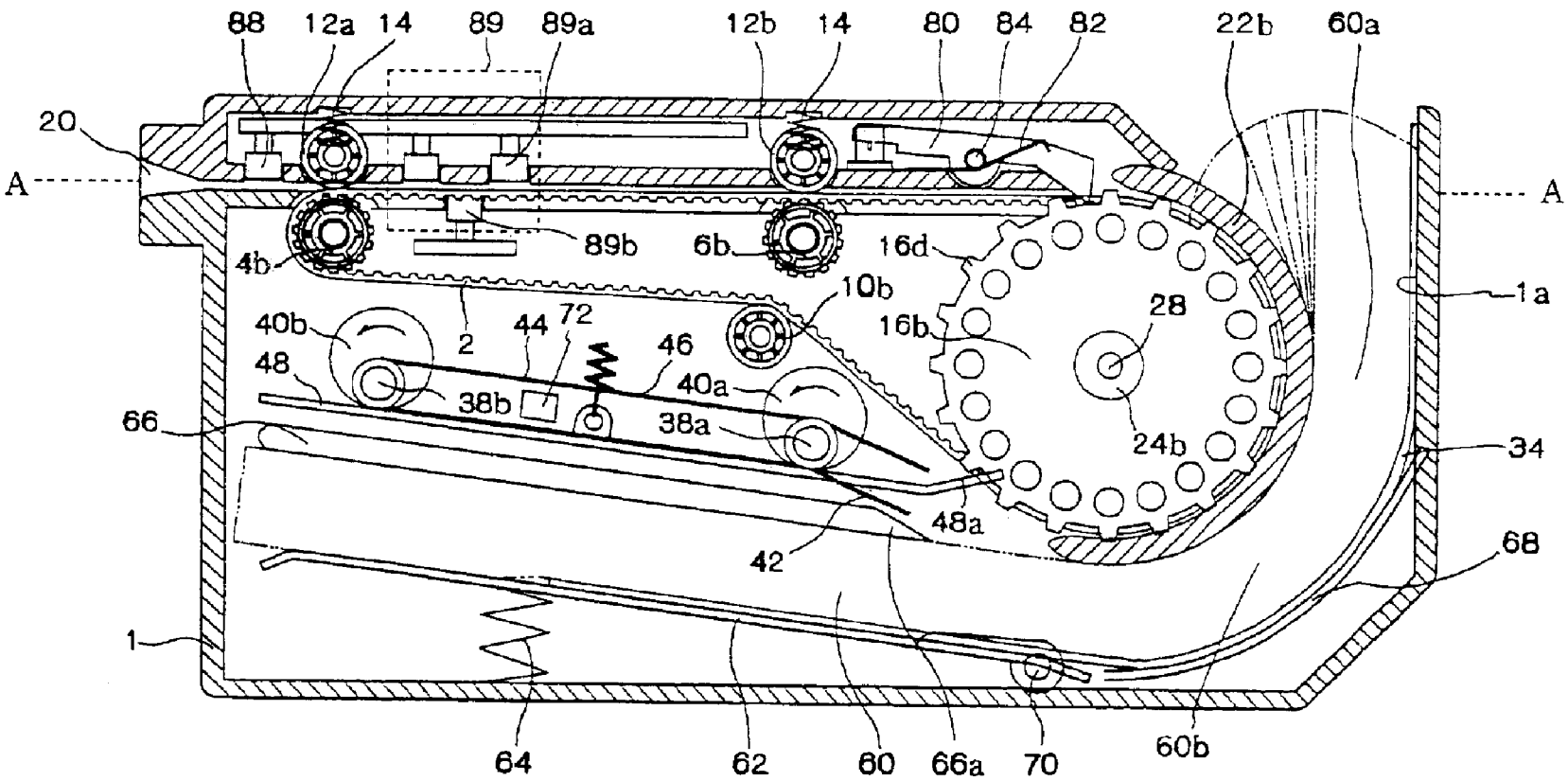
FIG. 2 is a side sectional view of the bill validator, in which bills are accommodated therein.
Figure 3:
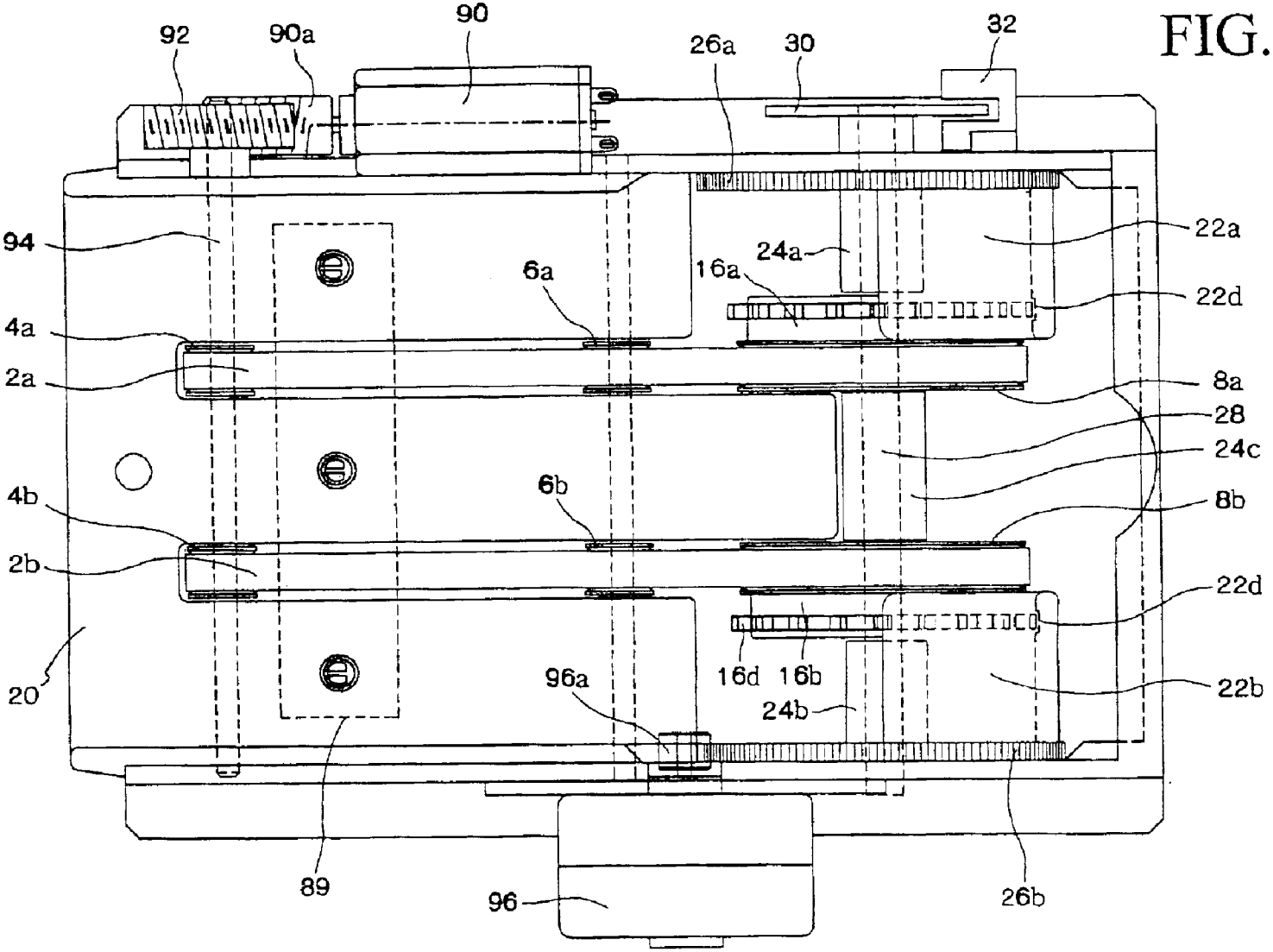
FIG. 3 is a sectional view taken along a line A—A shown in FIG. 1.

FIG. 1 is a schematic side sectional view of a bill validator of the present embodiment, in which no bills are accommodated, and FIG. 2 is a schematic side sectional view thereof, in which bills are accommodated. FIG. 3 is a sectional view taken along a line A-A shown in FIG. 1.

An inlet 20 is formed in a casing 1 of the bill validator. A couple of timing belts 2*a* and 2*b* are arranged, in parallel, in the traveling direction of a bill. The belts 2*a* and 2*b* are respectively engaged with outer pulleys 4*a* and 4*b*, which are provided close to the inlet 20, intermediate pulleys 6*a* and 6*b*, and inner pulleys 8*a* and 8*b*, which are provided far away from the inlet 20. Diameters of the inner pulleys 8*a* and 8*b* are greater than those of the intermediate pulleys 6*a* and 6*b* and the outer pulleys 4*a* and 4*b*. Idling pulleys 10*a* and 10*b* are respectively provided for the belts 2*a* and 2*b*. Press rollers 12*a* and 12*b* are respectively provided close to the pulleys 4*a*, 4*b*, 6*a* and 6*b* and biased by springs 14, so that the belts 2*a* and 2*b* are pinched by the press rollers 12*a* and 12*b* and the pulleys 4*a*, 4*b*, 6*a* and 6*b*.

Note that, the inner pulley 8*a* and 8*b* are provided on a rotary shaft 28 and capable of freely rotating thereon. Spacers 24*a*, 24*b* and 24*c* are provided to the rotary shaft 28.

Disk-shaped sending members 16*a* and 16*b* are respectively fixed to the inner pulleys 8*a* and 8*b* and rotated together with the inner pulleys 8*a* and 8*b*. As shown in FIG. 3, the sending members 16*a* and 16*b* are respectively fixed to the inner pulleys 8*a* and 8*b* and outwardly extended from the belts 2*a* and 2*b*. The sending members 16*a* and 16*b* are made of an elastic material, e.g., rubber. A plurality of elastic claws 16*d* are provided in outer circumferential faces of the sending members 16*a* and 16*b* with regular separations. Front ends of the sending claws 16*d* are outwardly extended from outer circumferential faces of the inner pulleys 8*a* and 8*b*.

As shown in FIG. 3, a warm screw 90*a* is fixed to a rotary shaft of a motor 90. The warm screw 90*a* is engaged with a warm gear 92, which is fixed to a shaft 94 of the outer pulley 4*a* and 4*b*.

With this structure, by driving the motor 90, the outer pulley 4*a* and 4*b* are rotated, and other pulleys 6*a*, 6*b*, 8*a*, 8*b*, 10*a* and 10*b* and the sending members 16*a* and 16*b* are rotated with the belts 2*a* and 2*b*. A bill sending mechanism, which sends the bill inward from the inlet 20 via a sending path, is constituted by the motor 90, the pulleys 4*a*, 4*b*, 6*a*, 6*b*, 8*a*, 8*b*, 10*a* and 10*b*, the sending members 16*a* and 16*b* and the belts 2*a* and 2*b*.

As shown in FIG. 1, guide members 22*a* and 22*b* act as a turning section for turning the traveling direction of the bill. The guide members 22*a* and 22*b* are formed into half-cylindrical shapes.

As shown in FIG. 3, gears 26*a* and 26*b* are fixed to the rotary shaft 28, which is rotatably held by the casing 1. The gears 26*a* and 26*b* are located close to inner faces of the casing 1.

The guide members 22*a* and 22*b* are respectively fixed in inner side faces of the gears 26*a* and 26*b*. The guide members 22*a* and 22*b* are coaxial with the gears 26*a* and 26*b* and capable of rotating together therewith. The guide members 22*a* and 22*b* partially cover the outer circumferential faces of the sending members 16*a* and 16*b*. Ends of the guide members 22*a* and 22*b* are extended until positions, at which the guide members 22*a* and 22*b* do not interfere with the belts 2*a* and 2*b*. When the bill is introduced into the bill validator, the guide members 22*a* and 22*b* are located at initial positions, at which the guide members 22*a* and 22*b* cover inner half parts of the inner pulleys 8*a* and 8*b*, so that a sending path for passing the bill is formed between the guide members 22*a* and 22*b* and the inner pulleys 8*a* and 8*b*.

Inner diameters of the guide members 22*a* and 22*b* are greater than outer diameters of the inner pulleys 8*a* and 8*b* and shorter than outer diameters of the sending members 16*a* and 16*b* including the claws 16*d*. Grooves 22*d* are respectively formed in inner faces of the guide members 22*a* and 22*b* so as to make the claws 16*d* separate from the guide members 22*a* and 22*b*. By forming the grooves 22*d*, the guide members 22*a* and 22*b* can be smoothly rotated without interfering with the claws 16*d*.

As shown in FIG. 3, a gear 96*a* is fixed to a rotary shaft of a motor 96. The gear 96*a* is engaged with the gear 26*b*, so that the integrated members 22*a* and 26*a* and another integrated members 22*b* and 26*b*, which are connected by the shaft 28, are rotated by the motor 96.

An encoder 30 is fixed to one end of the shaft 28. A photo sensor 32 detects rotational angle of the encoder 30 so as to detect positions or rotational angles of the guide members 22*a* and 22*b*.

As shown in FIG. 1, a bill accommodating section 60, which is a space for accommodating bills, is contiguous with the bill sending mechanism. Namely, the bill accommodating section 60 is provided under the pulleys 4*a*, 4*b*, 6*a*, 6*b*, 8*a* and 8*b*. When the bill is accommodated, the bill, which has been partially curved by the guide members 22*a* and 22*b*, is nearly horizontally accommodated in the section 60.

A lifting plate 62, which is capable of lifting the bills, is pivotably attached to the casing 1 by a shaft 70. The lifting plate 62 is always biased, by a spring 64, toward a couple of rails 66, which is fixed on inner side faces of the casing 1. A space between the lifting plate 62 and the rails 66 acts as the bill accommodating section 60.

The bill accommodating section 60 has an extended space 60*a*, which is a space extended from the bill accommodating section 60 to correspond to outer circumferential faces of the guide members 22*a* and 22*b*. The extended space 60*a* is formed between an inner faces 1*a* of the casing 1, an upper face of a supporting plate 68 and the outer circumferential faces of the guide members 22*a* and 22*b* located at the initial positions. The supporting plate 68, which is curved like a half-cylindrical shape, connects the inner face 1*a* of the casing 1 to the lifting plate 62. With this structure, the extended space 60*a* of the bill accommodating section 60 is formed into an L-shape along the supporting plate 68 and the guide members 22*a* and 22*b*.

A press plate 48 presses the bill as a press member. A center of the press plate 48 is always biased upward by a spring 46, whose one end is fixed, so that the press plate 48 elastically contacts cams 40*a* and 40*b*. An endless belt 44 is engaged with a pulley 38*a*, which is fixed to a shaft of the cam 40*a*, and a pulley 38*b*, which is fixed to a shaft of the cam 40*b*. Another endless belt 42 is engaged with the pulley 38*a* and a pulley (not shown), which is coaxially fixed to a gear engaged with the gear 96*a*.

By driving the motor 96, the cams 40*a* and 40*b* are rotated, so that the press plate 48 is moved upward and downward. Namely, the motor 96 simultaneously drives the guide members 22*a* and 22*b* and the press plate 48. Note that, angular speed of the guide members 22*a* and 22*b* is equal to that of the cams 40*a* and 40*b*. Therefore, the press plate 48 can be synchronously driven with the guide members 22*a* and 22*b*.

Guide sections 66*a* of the rails 66 are diagonally cut so as to easily introduce the bill, which has been sent by the sending members 16*a* and 16*b*, onto the rails 66.

One end section 48*a* of the press plate 48, which is close to the sending members 16*a* and 16*b*, is upwardly bent as a guide section so as to introduce the bill into a space between the press plate 48 and the rails 66.

The bill, which has been sent by the sending members 16*a* and 16*b*, is once spanned between the rails 66. The press plate 48 is moved downward by the cams 40*a* and 40*b*, so that the bill spanned between the rails 66 is pushed downward and stored in a space between the lifting plate 62 and the rails 66.

A bill detecting section 72 is provided in an upper part (on the press plate 48 side) of the bill accommodating section 60. In the present embodiment, the bill detecting section 72 is, for example, an optical sensor capable of checking if the bill exists in the bill accommodating section 60 or not.

A flexible holding member 34 is provided in the bill accommodating section 60. The holding member 34, which faces the outer faces of the guide members 22*a* and 22*b*, is inwardly extended from an inner face 1*a* of the casing 1, which defines the extended space 60*a*. An upper end of the holding member 34 is fixed to the inner face 1*a* of the casing 1; a lower end thereof is not fixed.

The flexible holding member 34 is formed into a plate and made of a flexible material, e.g., PET. A mid part of the holding member 34 is always biased toward the guide members 22*a* and 22*b* by its own elasticity, so that the mid part of the holding member 34 contacts or locates close to the outer faces of the guide members 22*a* and 22*b*.

A curved part of the bill, which has been moved toward the extended space 60*a* by rotation of the guide members 22*a* and 22*b*, is pressed toward the guide members 22*a* and 22*b* by the elasticity of the holding member 34, so that the bill can be elastically pinched between the holding member 34 and the guide members 22*a* and 22*b*.

In the present embodiment, a surface of the holding member 34, which faces the guide members 22*a* and 22*b*, is a rough face, e.g., an aventurine surface. Namely, fine projections are formed in the surface. By forming the fine projections, optical reflection rate of the holding member 34 can be lowered. In the case of accommodating no bills in the bill accommodating section 60, the bill detecting section 72 receives a reflected light reflected from the holding member 34. If the optical reflection rate of the holding member 34 is high, the bill detecting section 72 misjudges in spite of no bills. But, by forming the rough surface of the holding member 34, the light intensity of the reflected light form the holding member 34 is reduced, so that the bill detecting section 72 can correctly judge if the bill is accommodated in the bill accommodating section 60 or not. Preferably, the surface of the holding member 34 facing the outer faces of the guide members 22*a* and 22*b* may be colored black so as to further reduce the optical reflection rate.

Further, the rough surface of the holding member 34 is capable of reducing frictional resistance between the bill and the holding member 34, so that the bill can be smoothly introduced into the bill accommodating section 60.

Note that, the flexible material of the holding member 34 is not limited to PET. It may be any materials having enough elasticity. For example, a metal plate having enough elasticity may be used as the holding member 34. In the case of employing such metallic material, the surface of the holding member 34 facing the outer faces of the guide members 22*a* and 22*b* may be colored black so as to reduce the optical reflection rate as well.

A bill detecting sensor 88 detects the bill, which has been inserted into the inlet 20 (see FIG. 1). Detecting signals of the sensor 88 are sent to a control unit (not shown) of an introducing mechanism so as to drive the motor 90.

A bill identification section 89 is provided between the press rollers 12*a* and 12*b* so as to check the bill inserted from the inlet 20 (see FIG. 1). The bill identification section includes sensors 89*a* and 89*b* and a control section, which compares image data detected by the sensors 89*a* and 89*b* with stored image data. Namely, an actual image pattern of the bill inserted is compared with a stored image pattern of the bill. Note that, the sensors 89*a* and 89*b* are reflection-type photo sensors. Other means, e.g., magnetic sensors, infrared sensors, may be used as the sensors 89*a* and 89*b*.

A bill detecting claw 80 is pivotably attached to a shaft 84. A front end of the claw 80 is biased, by a spring 82, so as to press the bill. When the bill lift the front end of the claw 80 upward, the other end of the claw 80 closes a slit of a photo detector, which detects a light emitted by a light emitting element, so that the front end of the bill can be detected; when the rear end of the bill is moved away from the front end of the claw 80, the slit is opened so that the rear end of the bill can be detected. When the front end of the bill reaches the innermost position of the bill accommodating section 60, the rear end of the bill is separated from the claw 80. Signals for detecting the ends of the bill are sent to a control unit of the bill sending mechanism so as to correctly stop the motor 90.

Successively, sequential actions of the bill validator will be explained with reference to FIGS. 4A–4F.

The front end of the bill 99 is inserted into the inlet 20 until reaching a position between the belts 2*a* and 2*b* and the press rollers 12*a*. When the bill detecting sensor 88 detects the bill 99, the motor 90 is driven so as to move the belts 2*a* and 2*b*, so that a prescribed range of the bill 99 passes through the bill identification section 89. The bill 99 lifts the claw 80 upward, so that sending the bill 99 is known (see FIG. 4A). The bill identification section 89 identifies the bill and checks if the bill 99 is real one or false one. If the bill 99 is false one, the motor 90 is rotated in the reverse direction so as to discharge the bill 99 from the inlet 20. On the other hand, if the bill 99 is real one, the motor 90 is rotated in the normal direction so as to further send the bill 99 inward. When the front end of the bill 99 reaches the guide members 22*a* and 22*b*, the front end of the bill 99 is guided downward by inner side faces of the guide members 22*a* and 22*b*. The bill 99 is pinched between the guide members 22*a* and 22*b* and the claws 16*d* of the sending members 16*a* and 16*b*, and further sent inward by friction caused by the claws 16*d*.

A diameter of a virtual circle, which connects front ends of the elastic claws 16*d*, is greater inner diameters of the guide members 22*a* and 22*b*. When the claws 16*d* sends the bill 99, the front ends of the claws 16 are elastically deformed so that the bill 99 is pinched between the claws 16*d* and the inner faces of the guide members 22*a* and 22*b*. Namely, the bill 99 is properly sent by friction generated between the bill 99 and the claws 16*d*. When no bill exists between the claws 16*d* and the guide members 22*a* and 22*b*, the claws 16*d* passes through the grooves 22*d* of the guide members 22*a* and 22*b*, so no friction is generated therebetween, so that the sending members 16*a* and 16*b* can be rotated with small torque.

Note that, friction is generated between the bill 99 and the guide members 22*a* and 22*b*, but the guide members 22*a* and 22*b* are made of a proper material, e.g., a plastic or metal plate covered with Teflon (a trademark) sheet, so as to make the friction between the bill 99 and the guide members 22*a* smaller than that between the bill 99 and the claws 16*d*.

When the front end of the bill 99 passes the rear ends of the guide members 22*a* and 22*b*, the front end of the bill 99 is introduced into the space between the press plate 48 and the rails 66 by the guide section 48*a* of the press plate 48 and the guide sections 66*a* of the rails 66. Further, when the front end of the bill 99 reaches the innermost position of the bill accommodating section 60 and the rear end thereof leaves the bill detecting claw 80, the motor 90 is stopped so as to stop the bill sending action (see FIG. 4B).

Note that, when the rear end of the bill 99 leaves the claw 80, the front end of the claw 80 moves downward, so that reverse movement of the bill 99 toward the inlet 20 can be prevented.

When the bill 99 is completely accommodated, the motor 96 is driven so as to rotate the guide members 22*a* and 22*b*.

The guide members 22*a* and 22*b* are rotated in the direction opposite to the bill-introducing direction. When the guide members 22*a* and 22*b* are rotated about 180 degrees, the guide members 22*a* and 22*b*, which have been located between the extended space 60*a* of the bill accommodating section 60 and the bill are moved (see FIG. 4C and 3D). With this action, the rear part of the bill 99 can enter the extended space 60*a*. By further rotating the guide members 22*a* and 22*b* in the same direction, front ends of the guide members 22*a* and 22*b* enter a curved part of the bill 99, so that the outer circumferential faces of the guide members 22*a* and 22*b* securely pushes the rear part of the bill 99 toward the extended space 60*a* (see FIG. 4E). At that time, the guide members 22*a* and 22*b* are stopped at the initial positions (see FIG. 4F).

By controlling the motor 96 on the basis of the encoder 30 and the sensor 32, the stop of the guide members 22*a* and 22*b* can be properly controlled.

Further, the motor 96 simultaneously rotates the guide members 22*a* and 22*b* and moves the press plate 48 in the vertical direction.

Figure 4D:
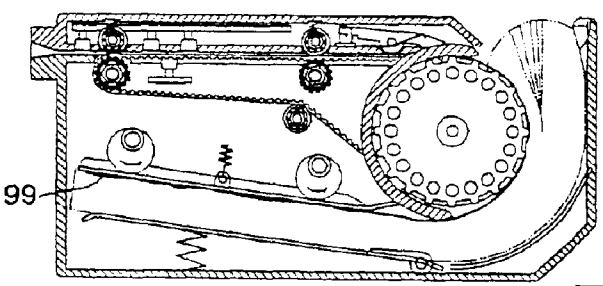
FIG. 4D is a side sectional views of the bill validator in which the guide member is half-turned, and the press plate reaches the lowermost position.
Figure 4E:
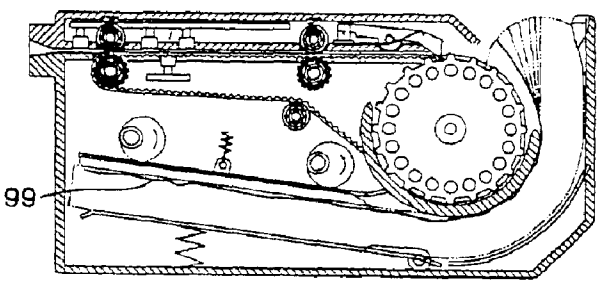
FIG. 4E is a side sectional views of the bill validator in which the guide member is rotated in 270 degrees, and the press plate returns.
Figure 4F:
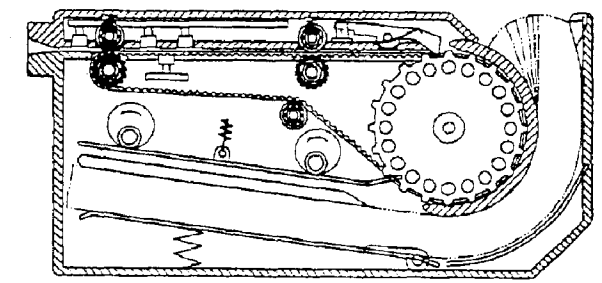
FIG. 4F is a side sectional views of the bill validator in which the guide member and the press plate are reaches initial positions, and the bill is completely accommodated in the bill accommodating section.
Figure 4A:
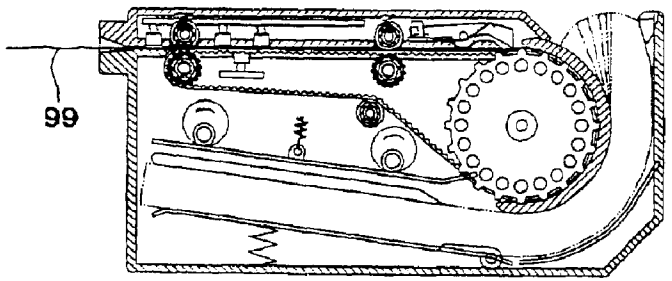
FIG. 4A is a side sectional views of the bill validator in which a front end of a bill reaches a guide member.
Figure 4B:
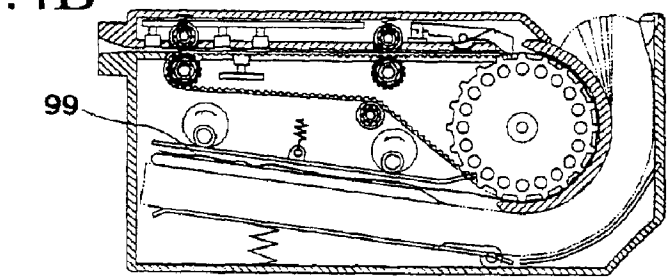
FIG. 4B is a side sectional views of the bill validator in which the front end of the bill reaches an inner part of a bill accommodating section.
Figure 4C:
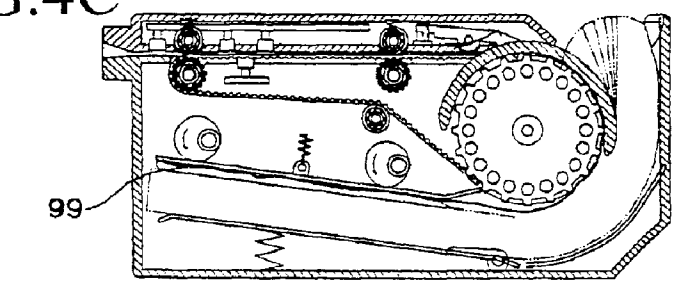
FIG. 4C is a side sectional views of the bill validator in which a guide member is started to rotate, and a press plate begins to move downward.

The motor 96 is driven when the bill 99 is held between the rails 66, the cams 40*a* and 40*b* are rotated so as to push the bill 99 downward together with the press plate 48 (see FIGS. 4B and 4C). When the press plate 48 is further pressed downward, the bill 99 is bent along a center line thereof, so that the bill 99 is disengaged from the rails 66, and the front part of the bill 99 is moved to the bill accommodating section 60 under the rails 66 (see FIG. 4D). Then, the motor 96 is further rotated so as to move the press plate 48 upward (see FIG. 4E). The press plate 48 is stopped at the initial position (see FIG. 4F). Therefore, the bill 99 is pressed by bottom faces of the rails 66 and stayed in the bill accommodating section 60.

When the guide members 22*a* and 22*b* are rotated 180 degrees, the press plate 48 reaches the lowermost position. Namely, by synchronously moving the guide members 22*a* and 22*b* and the press plate 48, moving the bill 99 into the extended space 60*a* of the bill accommodating section 60 and pressing the bill 99 by the press plate 48 can be executed simultaneously. With this action, the front part and the rear part of the bill 99 are simultaneously moved to the bill accommodating section 60, so that the bill 99 can be quickly and smoothly accommodated in the bill accommodating section 60. In the present embodiment, by commonly using the driving mechanism, the bill validator can be small-sized and manufacturing cost can be reduced.

A mid curved portion of the bill 99, which has been moved to the extended space 60*a* by rotation of the guide members 22*a* and 22*b*, is pressed toward the guide members 22*a* and 22*b* by the holding member 34, so that the bill 99 can be held therebetween. Therefore, the mid portion of the bill 99 is not slack. In the case of accommodating a plurality of the bills 99, they can be held in the same postures in a curved part 60*b* of the bill accommodating section 60.

Note that, the holding member 34 is not an essential element. In the case of accommodating a small number of the bills 99, if the holding member 34 is not employed, the mid portions of the bills 99 is slackened along the plate 68 in the curved part 60*b* of the bill accommodating section 60, and the bills 99 cannot be accommodated in the same postures. Further, the slackened bills 99 obstruct the travel of the bill 99 newly inserted and causes jamming, so that the bills 99 cannot be uniformly arranged in the bill accommodating section 60. A user cannot easily take out the bills 99 therefrom. Therefore, it is advantageous to employ the holding member 34.

By employing the bill validator, the total length including the bill accommodating section 60 can be shorter. The height is almost equal to that of the conventional device. Therefore, the total size of the bill validator of the present embodiment can be smaller. The small or compact bill validator can be assembled in a small-space of a game machine, etc., so that a required space for installing the device can be smaller.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. A bill validator, comprising:

a casing;

an inlet from which a bill is inserted;

a bill sending mechanism sending the bill inward from said inlet via a sending path;

a bill identification section being provided to a mid part of the sending path;

a turning section turning a traveling direction of the bill which is sent by said bill sending mechanism; and a bill accommodating section being contiguous with said bill sending mechanism, said bill accommodating section accommodating the bill which has been turned by said turning section, wherein said bill accommodating section has an extended space, which corresponds to an outer part of said turning section, and a rear part of the bill accommodated in said bill accommodating section is curved in said extended space.

2. The bill validator according to claim 1, wherein said turning section includes:

a half cylindrical-shaped guide member being capable of rotating about an axial line, said guide member having an outer face, which faces said extended space at an initial position, and an inner face, which guides the bill so as to turn the bill; and a rotating mechanism rotating said guide member until the outer face of said guide member reaches a position opposite to the initial position so as to make the bill enter said extended space when the rear part of the bill reaches the inner face of said guide member.

3. The bill validator according to claim 2, wherein said bill sending mechanism includes a disk-shaped sending member, and said guide member is provided coaxial with said sending member and capable of rotating about an axial line of said sending member.

4. The bill validator according to claim 3, wherein said sending member includes a plurality of elastic claws, which are provided in an outer circumferential face of said sending member and outwardly projected therefrom, and a groove, through which said claws pass, is formed in the inner face of said guide member.

5. The bill validator according to claim 2, wherein said bill sending mechanism includes: an outer pulley; an inner pulley; an endless belt being engaged between said pulleys; and a press roller pressing the bill onto said endless belt, and said guide member is coaxial with said inner pulley and capable of rotating about an axial line of said inner pulley.

6. The bill validator according to claim 2, further comprising:

a couple of rails holding side edges of a front part of the bill, which has been turned by said turning section;

a press member pressing the front part of the bill, which has been held by said rails, so as to accommodate the bill into said bill accommodating section; and a driving section driving said press member.

7. The bill validator according to claim 6, wherein said rotating mechanism and said driving section are synchronously driven.

8. The bill validator according to claim 2, further comprising a flexible holding member being extended inward from an inner face of said casing, which faces the outer face of said guide member located at the initial position, said holding member elastically holding the bill with the outer face of said guide member.

9. The bill validator according to claim 8, wherein a surface of said holding member, which faces said guide member, is a rough surface.

10. The bill validator according to claim 9, further comprising a bill detecting section, which optically detects a bill on the holding member.

11. The bill validator according to claim 1, further comprising a bill detecting section, which detects a bill in said bill accommodating section.

* * * * *